US005123320A

United States Patent [19]

Hochfeld

[11] Patent Number: 5,123,320

[45] Date of Patent: Jun. 23, 1992

[54] COIN ROLL OPENING DEVICE

[76] Inventor: Stanley Hochfeld, 80-16 151st Street, Howard Beach, N.Y. 11414

[21] Appl. No.: 774,449

[22] Filed: Oct. 10, 1991

[51] Int. Cl.[5] ..... B26D 1/02

[52] U.S. Cl. ..... 83/856; 30/2; 225/93

[58] Field of Search ..... 30/2; 83/856, 946; 225/93

[56] References Cited

U.S. PATENT DOCUMENTS

| | | | |
|---|---|---|---|
| 3,781,987 | 1/1974 | Gentscheff | 30/2 |
| 4,001,934 | 1/1977 | Bell | 30/124 |
| 4,040,183 | 8/1977 | Cassier | 30/296.1 |
| 4,333,234 | 6/1982 | Smith et al. | 30/2 |
| 4,382,330 | 5/1983 | Harbaugh | 30/124 |
| 4,757,611 | 7/1988 | Tommi et al. | 30/2 |
| 4,825,738 | 5/1989 | Jones | 30/2 X |
| 4,852,253 | 8/1989 | Uchida | 30/2 |
| 4,852,255 | 8/1989 | Hochfeld | 30/102 |
| 5,086,962 | 2/1992 | Costello | 225/93 |

*Primary Examiner*—Douglas D. Watts
*Assistant Examiner*—Kenneth E. Peterson
*Attorney, Agent, or Firm*—Frishauf, Holtz, Goodman & Woodward

[57] ABSTRACT

A coin roll opening device for opening a roll of coins safely, quickly and conveniently includes a horizontal body member coupled at substantially a right angle to a vertical body member extending downward from the horizontal body member. At least one of the horizontal and vertical body members defines a curved receiving surface for receiving a roll of coins. A blade is inserted in the curved receiving surface, and when a wrapped roll of coins is struck up against the blade and the curved receiving surface, the wrapper is pierced and easy access to the coins is gained.

20 Claims, 3 Drawing Sheets

COIN ROLL OPENING DEVICE

BACKGROUND OF THE INVENTION

This invention relates to a device for quickly and conveniently exposing and removing coins from a wrapped roll of coins and, more specifically to a device adapted for slicing, tearing, piercing or scoring the wrapper (made of paper, plastic, etc.) of a coin roll to facilitate opening of the coin roll and removal of coins therefrom. The devices of the present invention will be designated "coin roll openers" throughout the specification and claims.

It is common practice for banks and businesses to utilize coin wrappers. The wrappers are manufactured of either paper or plastic, or any other suitable material, and in certain lengths and diameters so as to accommodate a given number of a particular coin denomination. For example, a penny wrapper is sized to have fifty pennies fitted into it. Other specially sized wrappers are available to have fitted therein given numbers of nickels, dimes and quarters.

Once the coins are inserted into the wrapper, the ends of the wrapper are closed or otherwise turned under or reduced in size to complete the wrapping. The coins in such a wrapped roll can then be handled easily and in known dollar values, with assurance that the contents of the roll will not spill out.

In use, the wrapped roll of coins are distributed to cashiers who must, as a matter of course, make change for customers. When the cashier runs out of a certain coin denomination, a roll of that coin denomination is opened and its contents are spilled into the cash register for ready availability. How the coin roll is opened by the cashier forms the subject of the present invention.

When a cashier needs to open a wrapped roll of coins, the coin roll will normally be firmly grasped and sharply banged indiscriminantly against an edge of a cash register, a money drawer of the cash register, a countertop or other nearby object. As a result of this blow to the roll of coins, the wrapper is at least partly split or broken so that its contents can be easily removed.

Although this procedure is effective, it also is problematic for both the cashier and whichever of the cash register, countertop or other object against which the cashier indiscriminantly chooses to smash the coin roll u against in order to gain access to its contents.

The multiple repeated blows delivered by the very hard coin roll can result in damage to the cash register (i.e. to the electronics of the cash register, the drawer(s), drawer tracks, display(s), etc.), countertop or other object against which the coin roll is smashed.

Cash registers have become less sturdy and more complicated. The metal of cash registers of times past has been typically replaced by plastic, and the sturdy internal mechanisms have been replaced by electronic elements that perform calculations and various other sensing and data processing functions. When a coin roll is banged against any part of the cash register, shock waves travel throughout the machine to all of its components. Such shocks may cause expensive-to-repair damage to not only the mechanical or structural components of the cash register, but also the electronics and other shock-sensitive components of the cash register, including sensitive display elements.

Countertops and other objects too have become more delicate. The hard wood of countertops and other sturdy objects of times past has been typically replaced by Formica or other less sturdy materials. These newer materials are not as capable of withstanding over the course of time multiple repeated blows from very hard objects such as metal coin rolls. Very often, the impact of the coin rolls physically damages the countertops or other objects.

Since the cashier may need to open quite a large number of coin rolls during the course of a business day, the repetition of shocks to the hands from repeated smashings, day after day, can result in injury to the cashier over a long period of time.

Coin roll openers known in the prior art include both handheld opening devices, such as those exemplified in U.S. Pat. Nos. 4,852,255 (Hochfeld), 4,852,253 (Uchida), 4,757,611 (Tommi et al.) and 4,001,934 (Bell), and mountable devices, such as those exemplified in U.S. Pat. Nos. 4,825,738 (Jones), 4,382,330 (Harbaugh) and 4,040,183 (Cassier).

The problem with the known handheld opening devices of the prior art is that due to the extra time and effort it requires to pick up and operate the devices, they tend not to be used. The problem with the known mountable devices of the prior art is that they too require operation motions to which cashiers are unaccustomed and thus also tend not to be used. Moreover, the known prior art mountable devices further take up otherwise usable countertop or cashier space and interfere with everyday normal operations.

SUMMARY OF THE INVENTION

It is an object of the present invention to provide a coin roll opening device for opening a roll of coins safely, quickly and conveniently.

It is a further object of the present invention to provide a coin roll opening device for opening a roll of coins safely, quickly and conveniently, and which allows the user to use the typical smashing motion to which cashiers are presently accustomed.

It is still a further object of the present invention to provide a coin roll opening device for opening a roll of coins safely, quickly and conveniently, and which provides a target for a cashier's smashing motion so that the cashier doesn't indiscriminantly bang and cause damage to an electronic cash register, countertop or other object.

It is still a further object of the present invention to provide a coin roll opening device for opening a roll of coins safely, quickly and conveniently, and which provides a cushion for a cashier's smashing motion so that the cashier is less likely to be injured from repeatedly opening of wrapped rolls of coins.

It is still a further object of the present invention to provide a mountable coin roll opening device for opening a roll of coins safely, quickly and conveniently, and which substantially does not interfere with countertop or cash register space.

It is still a further object of the present invention to provide a mountable coin roll opening device for opening a roll of coins safely, quickly and conveniently, and which provides a large advertising space for corporate logos, slogans, messages, phone numbers for supplies or services, etc.

It is still a further object of the present invention to provide a mountable coin roll opening device for opening a roll of coins safely, quickly and conveniently, and which provides easy application of advertising messages and easy changing of advertising messages by providing removable or interchangeable surfaces on which the advertising messages appear.

DETAILED DESCRIPTION

Figure 1:
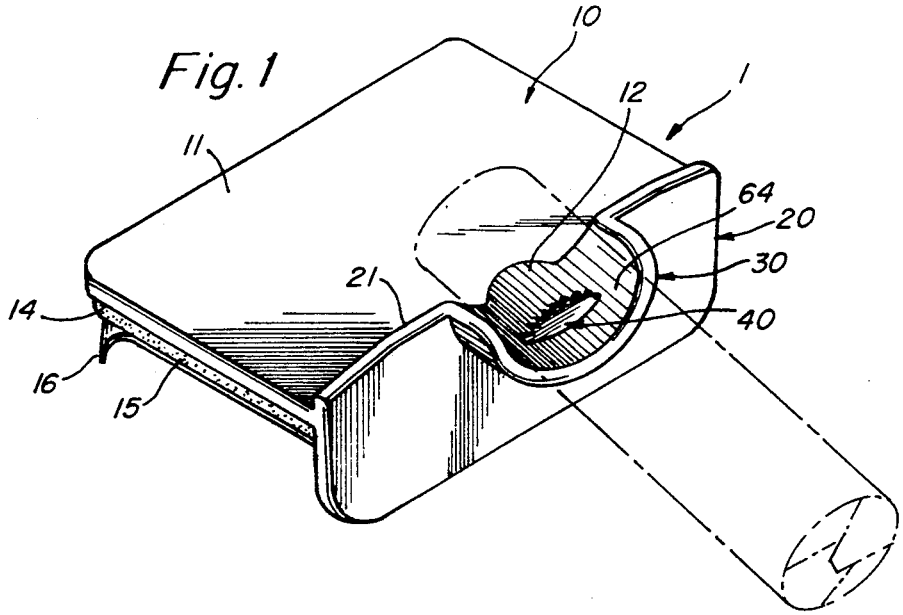
FIG. 1 is a perspective view of a first embodiment of the present invention, showing a wrapped coin roll in phantom lines, in operative position to be broken.
Figure 2:
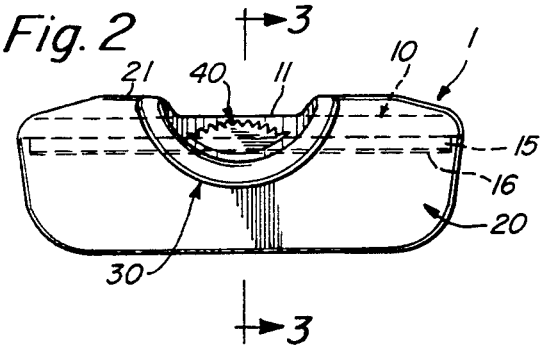
FIG. 2 is a front view of the first embodiment of the present invention.
Figure 3:
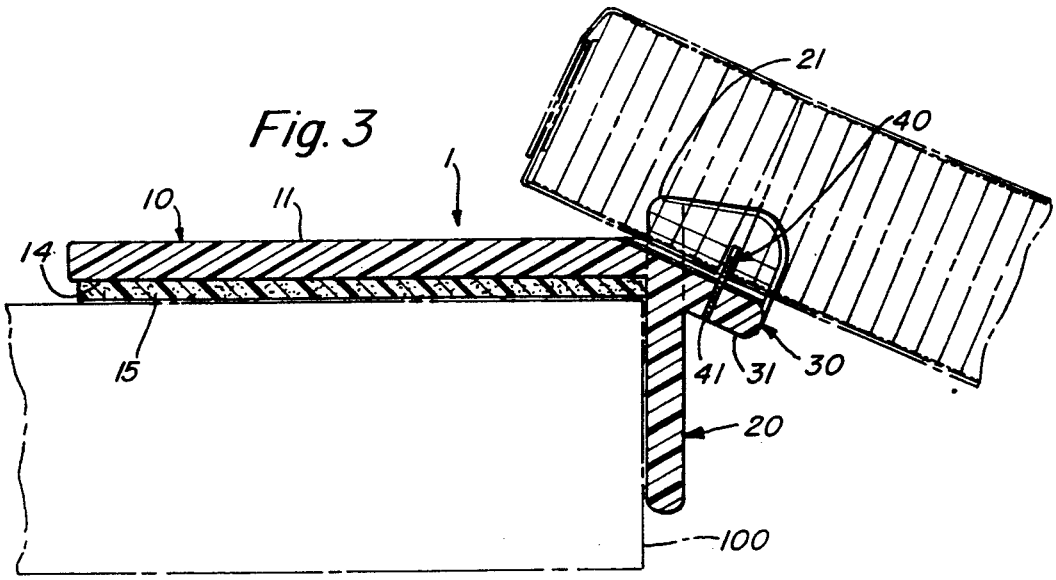
FIG. 3 is a sectional view taken along line 3—3 in FIG. 2, showing a coil wrapper being broken.

FIGS. 1-3 depict a first embodiment of a coin roll opening device 1 which is used to open a wrapped roll of coins.

The coin roll opening device 1 of the present invention, as shown in FIGS. 1-3, comprises a horizontal body member 10, a vertical body member 20, and a lip member 30, each made of molded plastic or another suitable material, and a blade means 40 made of hardened, serrated metal, smooth-edged metal, hard plastic, or another suitable material. The blade is shown with a serrated or toothed edge by way of example.

The coin roll opening device 1, as seen in FIGS. 1 and 3, has a substantially L-shaped profile. The horizontal body member 10 has a substantially flat top surface 11 and is coupled to vertical body member 20 at substantially a right angle. Vertical body member 20 extends downward from horizontal body member 10 and has a lip member 30 projecting therefrom along top edge portion 21 of vertical body member 20. The horizontal body member 10, vertical member 20 and lip member 30 are preferably integrally molded as a single piece from plastics material such as nylon, Delrin (reg. trademark), or other suitable plastics material.

The lip member 30 and the top edge portion 21 of vertical body member 20 curve together in a substantially semicircular arc-like shape. Other suitable shapes could be used. Horizontal body member 10 includes a curved indentation 12 at the area where horizontal body member 10, vertical body member 20, and lip member 30 meet. Together, the lip member 30, the top edge 21 of vertical body member 20 and the curved indentation 12 of horizontal body member 10 define a curved receiving surface 64 for receiving a roll of coins as clearly seen in FIGS. 1 and 3.

Blade means 40 is provided in the curved receiving surface 64 and held by lip member 30 to extend from a bottom portion 31 of lip member 30 to below the substantially flat top surface 11 of horizontal body member 10. The curved receiving surface 64 and blade means 40 together form a target at which a roll of coins is aimed to be pressed against or smashed against the blade 40. Pressing (and optionally twisting) with a smoothly applied force (as opposed to smashing with a sharply applied force) is generally sufficient to break open the coin roll wrapper by the blade 40, and causes less damage to the user's hand.

The blade 40 is shown in the illustrated embodiment as being inserted into a slot 41 in the lip member 30 (see FIG. 3). The blade 40 can be press-fit in the slot 41, or can be adhered by means of an adhesive to lip member 30 within slot 41, as desired. Other bonding techniques could be used. Alternatively, the blade can be insert-molded together with the integrally formed horizontal body member 10, vertical member 20 and lip member 30.

Still further, the blade can be integrally formed of the same material as lip member 30 during the molding process, in which case the blade would be of the same material as the remainder of the device. While metal is preferred for the blade 40, in some instances, fabrication of the blade 40 from hard or otherwise strong plastics material will be suitable.

In operation, a wrapped coin roll is struck up or pressed against the target provided by the curved receiving surface 64 and blade 40. The coin roll first makes contact with the blade 40, and a wrapper of the coin roll, whether plastic or paper or other suitable material, is pierced or otherwise broken upon impact or by the pressing force. As the smashing stroke or more gentle pressing continues to move the coin roll downward, the blade 40 continues to be further inserted into the wrapped roll of coins. When the blade 40 penetrates between a pair of adjacent coins, continued downward movement of the coin roll is stopped when the coin roll impacts the curved receiving surface 64 of lip 30. The wrapper of the coin roll has thus been scored or broken and access to the coins is gained.

The blade means 40, as shown in FIG. 1, may be provided at an angle outwardly inclined from the vertical body member 20 so that the blade 40 means contacts a coin roll being opened substantially perpendicular to the surface of the wrapper. A coin roll to be opened is typically smashed up against or gently pressed against the coin roll device 1 at an angle, and the blade 40 can thus be inclined to complement the angle of impact or pressing of a coin roll against the coin roll device 1. The advantages of inclining the blade 40 to complement the angle of impact or pressing are that piercing of the wrapper is made easier and the blade 40 may further be more deeply inserted into the coin roll smoothly sliding between the rolled coins.

The coin roll device 1 of the present invention provides a clear and obvious target for applying a coin roll thereagainst so that an operator will not indiscriminantly strike and damage an electronic cash register, countertop or other sensitive equipment.

Further, the coin roll device 1 allows for an operator to open a roll of coins using the typical smashing or pressing motion to which operators are presently accustomed. This feature of the coin roll device 1, combined with the increased ease of opening a coin roll which the present invention provides over a typical blunt end edge of the cash register or countertop that is now typically used to open coin rolls, makes it likely that the coin roll device 1 of the present invention will find favor with operators, much to the pleasure of the owners of sensitive cash registers or delicate countertops, and also find favor with advertiser's looking for high visibility consumer exposure.

FIG. 3 shows coin roll opening device 1 mounted on a countertop 100. The substantially L-shaped profile of the coin roll opening device 1 fits snugly up against the edge of a flat surface such as a countertop 100. The mounted coin roll device 1 thus substantially does not interfere with countertop or cash register space.

As shown in FIGS. 1 and 3, the bottom face 14 of horizontal body member 10 is provided with gripping means 15 for gripping the countertop 100 or other object on which the coin roll device 1 is mounted. The gripping means 15 may be, for example, a double adhesive surface and may be covered by a peel-away layer 16 which is removed prior to mounting of the coin roll device 1 to uncover the gripping means 15. After removal of the peel-away layer 16, the device is stuck to the countertop, as seen in FIG. 3.

Figure 4:
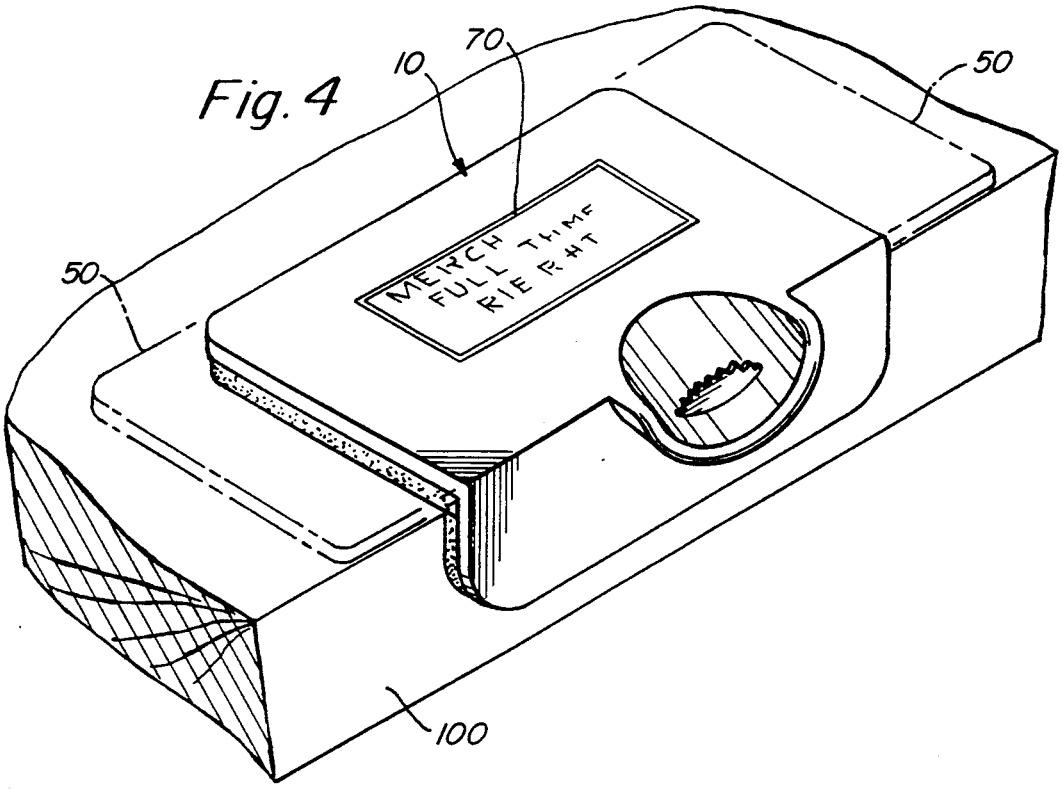
FIG. 4 is a perspective view of a modified embodiment of the present invention, mounted on a countertop or the like, showing application of an advertising message.

Preferably, the gripping means 15 provides a shock absorbing means (such as a foam resilient layer shown in FIGS. 1 and 3) for absorbing the shock of the impact of a roll of coins up against the coin roll device 1. In this manner the repeated shock to an operator's hands from repeated smashings or pressing of coin rolls over the course of a day are reduced, and the likelihood of injury is reduced. The shock absorbing means may comprise a foam layer (such as foam rubber or plastic) coated on both sides with an adhesive, one side of which is adhered to the underside of member 10 and the other side of which is adhered to the countertop or the like. The foam material may also be provided under vertical member 20 (as shown in FIG. 4) to further improve the shock absorbing feature.

The blade means 40 preferably does not extend above the substantially flat top surface 11 of horizontal body member 10 and is shielded by lip member 30 so that the blade means 40 poses substantially no threat of inadvertently damaging goods or injuring the hand of an operator.

The top edge 21 of vertical body member 20, as shown in FIG. 1, may extend above the substantially flat top surface 11 of horizontal body member 10 by a small distance to further shield blade means 40 so that it is accessible only to direct impact by a coin roll. Alternatively, as shown in FIG. 4., the top edge 21 of vertical body member 20 may extend only to reach the upper substantially flat top surface 11 of horizontal body member 10 so that the coin roll device 1 has a flatter profile and interferes less with activities occurring on the countertop or other surface on which the coin roll device 1 is mounted.

The substantially flat top surface 11 of horizontal body member 10 provides substantially large advertising space on which an advertising message 70 can be imprinted or otherwise secured. An advertising message may be printed directly on substantially flat top surface 11 of horizontal body member 10 (as shown in FIG. 4) or may be adhesively applied (for example by way of a label or other self-stick sheet) to substantially flat top surface 11 of horizontal body member 10. The substantially flat top surface 11 of horizontal body member 10 may extend outwardly in both directions past the width of the vertical body member 20 (as shown by dashed lines and reference number 50 in FIG. 4) to provide greater stability to the coin roll opening device and to provide a greater advertising space. The advertising message may be arranged to face the customer or consumer, or to face the cash register operator, depending upon the nature of the message and the type of person the advertiser wishes to reach.

Figure 5:
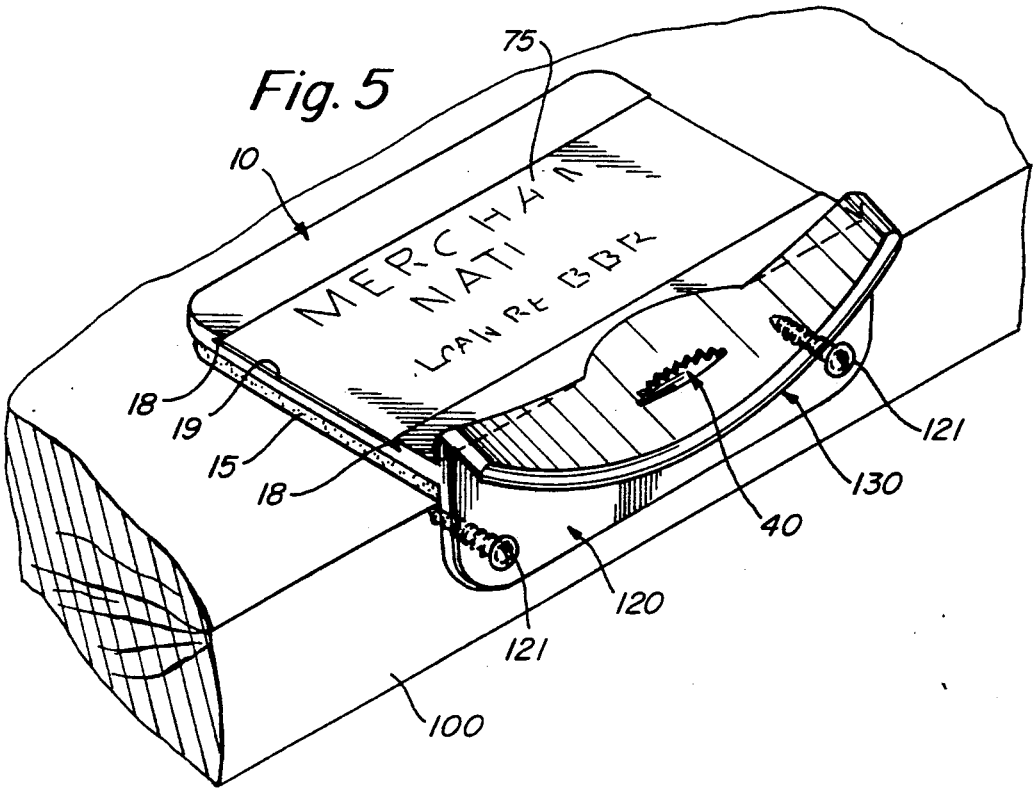
FIG. 5 is a perspective view of another embodiment of the present invention, mounted on a countertop.

Horizontal body member 10, as shown in FIG. 5, may be provided with insertion means 18 (elongated groove) for receiving an insertable advertising message 75. The insertion means 18 shown in FIG. 5 comprises two grooved overhangs and a central depression 19 therebetween, running along the width of horizontal body member 10. The advertising message unit 75 shown in FIG. 5 comprises a flat insertable card, plate, or the like, which may be fitted into, secured by and removed from the insertion means 18. The insertable advertising message unit 75 has side edges which are generally V-shaped in the illustrated embodiment so as to mate with the generally V-shaped grooves 18 of the insertion means of the body member 10. Therefore, the advertising message unit 75, which is preferably in the form of a plate-like member, can be easily slid into the grooves, and is positively retained in the grooves. Easy application and interchange of advertising messages is thus achieved.

As shown in FIG. 5, the lip member 130 can be widened and enlarged in the horizontal direction, so as to provide a larger target area for a coin roll. In this manner, even if a coin roll is smashed or pressed against the device of the present invention, the operator does not have to be as accurate in locating the coin roll, since the sloped side edges of enlarged lip member 130 will effectively serve as a guide to guide the coin roll applied thereagainst to the blade means 40 for opening of the coin roll. In this embodiment, even if the coin roll is applied toward an edge of the device, as the coin roll slides downwardly along the inclined side edges of the lip member 130, the coin roll will impinge upon the blade member 40 from one side thereof, and produce the desired effect of breaking the coin roll.

As seen in FIG. 5, the device may be provided with holes or openings in the vertical member 120 at opposite ends thereof for passing screws 121 or the like therethrough, for more positive securement of the device to a countertop or the like. Nails may be used in place of screws 121. The nails or screws 121 are preferably used in conjunction with the resilient foam-type adhering member 15 to provide shock absorbing characteristics to prevent injury to the user.

Figure 6:
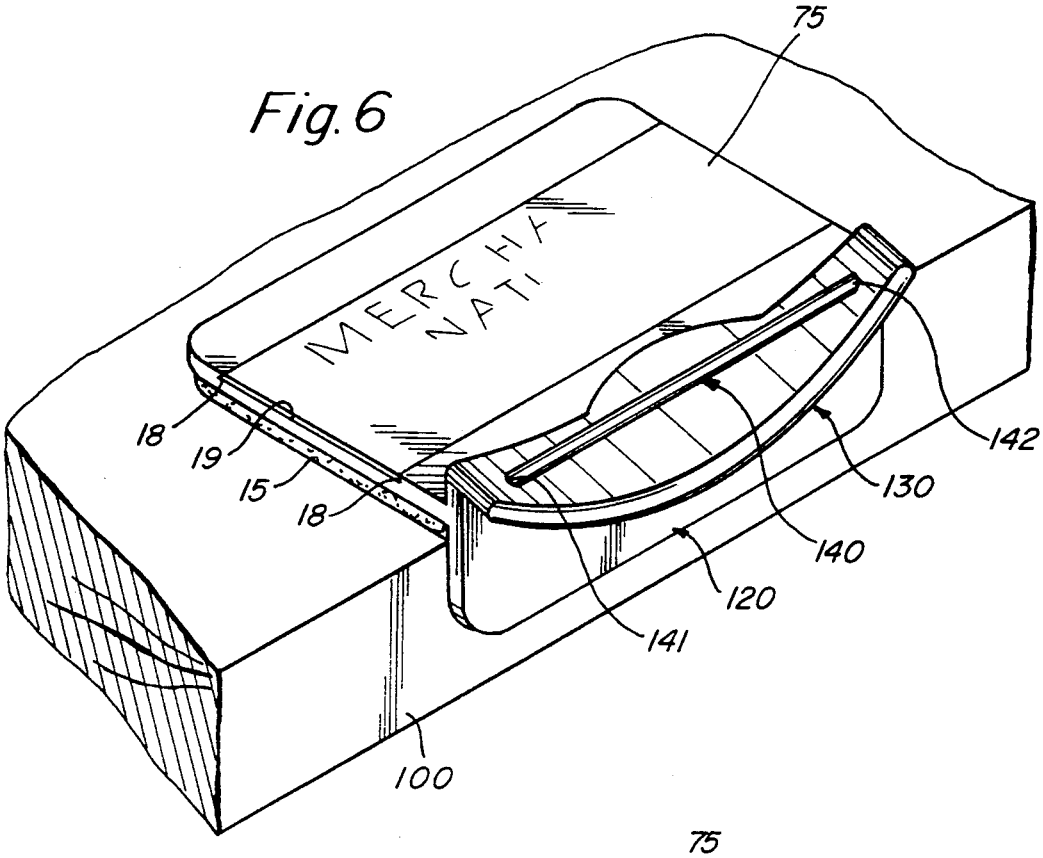
FIG. 6 is a perspective view of still another embodiment of the present invention.

FIG. 6 shows another embodiment of the invention wherein the blade member 40 is replaced by a horizontal bar-like member 140 which is anchored (i.e. embedded) at its ends 141, 142 in the enlarged lip member 130. The bar 140 may preferably have a rounded upper edge (as shown in FIG. 6) so as to prevent injury to the user. When the coin roll is smashed or pressed against the bar 140, sufficient force can be generated to break a coin roll, as desired.

Figure 7:
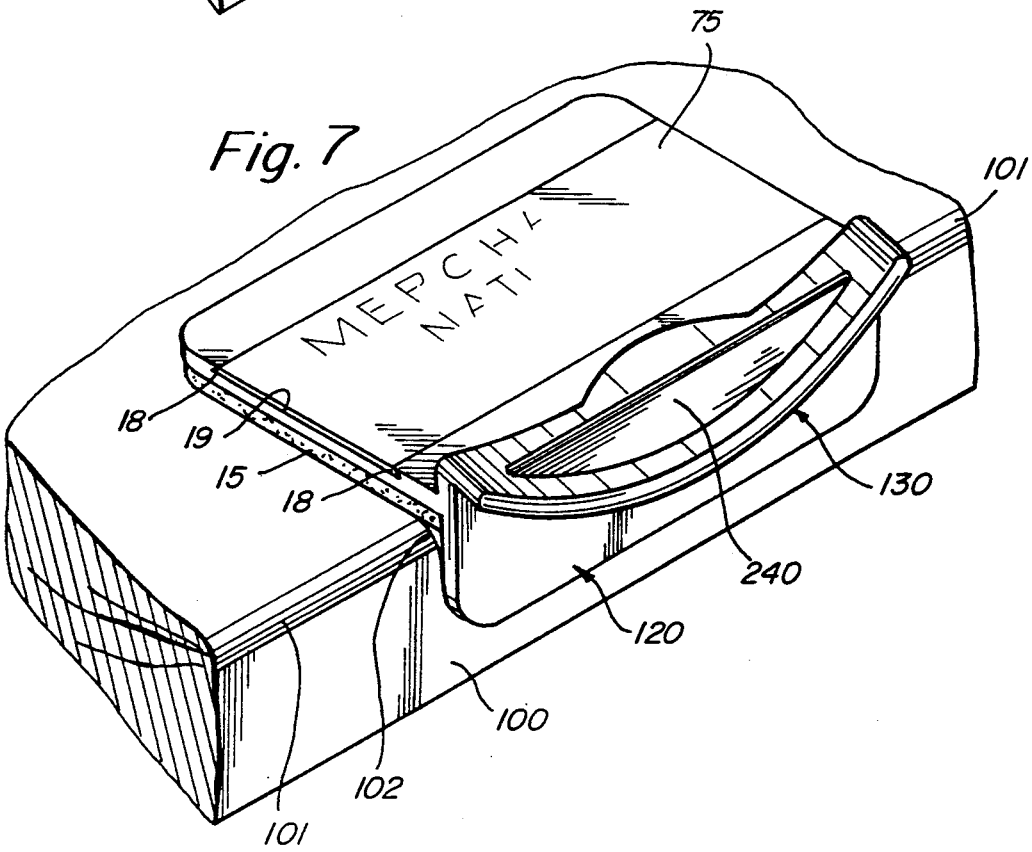
FIG. 7 shows a modification of the embodiment of FIG. 6.

FIG. 7 shows yet another embodiment similar to FIG. 6, but wherein the bar 140 is replaced by a projecting plate-type blade member 240 which extends horizontally over a substantial portion of the enlarged lip member 130. Operation is similar to the embodiment of FIG. 6. The upper edge of the plate-like blade member 240 may be rounded (as shown), or flat, or serrated, or sharpened, as desired. However, a rounded or flat edge is preferred for safety purposes.

As shown in FIG. 7, when the front edge 101 of the countertop 100 or other support member is rounded, as shown by 101 in FIG. 7, an elongated spacer member 102 may be provided between the inner corner of the coin roll opening device 1 and the front rounded edge 101 of the countertop, to provide more positive securement of the coin roll opening device 1 to the countertop. Spacer member 102 preferably extends along the entire width of coin roll opener 1 and is secured thereto by, for example, self-stick adhesive.

The scope of the present invention is not intended to be limited to the embodiments particularly shown in the drawings and described above in the specification. For example, the various specific features of each of the illustrated embodiments may be combined in any combination with the other illustrated embodiments, consistent with the operation and function thereof. It will be obvious to those skilled in the art that various changes may be made without departing from the spirit and scope of the present invention as defined by the following claims.

What is claimed is:

1. A coin roll opening device for opening a wrapped roll of coins, comprising:

a horizontal body member having a substantially flat top surface and a substantially flat bottom surface placeable on a support surface of a support member;

a vertical body member coupled to said horizontal body member at substantially a right angle to said horizontal body member, said vertical body member extending downwardly from said horizontal body member and having a back side abuttable against another surface of said support member, said another surface extending substantially perpendicular to said support surface;

at least one of said horizontal and vertical body members defining a curved receiving surface for receiving a roll of coins; and a blade means on said curved receiving surface and projecting from said curved receiving surface for piercing a wrapper of a coin roll when said coin roll is struck up against said blade means.

2. The coin roll opening device of claim 1, wherein said curved receiving surface includes a lip member, coupled to said vertical body member along a top edge portion of said vertical body member, for holding said blade means.

3. The coin roll opening device of claim 2, wherein the substantially flat top surface of the horizontal body member includes a curved indentation where said horizontal body member, said vertical body member and said lip member meet.

4. The coin roll opening device of claim 2, wherein said blade means extends upward from a bottom portion of said lip member to below said substantially flat top surface of said horizontal body member.

5. The coin roll opening device of claim 2, wherein said blade means extends upward from a bottom portion of said lip member at an angle outwardly inclined from said vertical body member.

6. The coin roll opening device of claim 2, wherein said top edge portion of said vertical body member extends above said substantially flat top surface of said horizontal body member

7. The coin roll opening device of claim 1, wherein a gripping means is affixed to the bottom surface of said horizontal body member for grippingly mounting said coin roll opening device on a countertop, cash register or other object.

8. The coin roll opening device of claim 7, wherein said gripping means includes cushioning means for absorbing shock when said coin roll is struck up against the coin roll opening device.

9. The coin roll opening device of claim 1, wherein said substantially flat top surface of said horizontal body member includes advertising space.

10. The coin roll opening device of claim 1, wherein said substantially flat top surface of said horizontal body member includes insertion means for accepting, holding and allowing removal of an insertable advertising message.

11. A coin roll opening device for opening a wrapped roll of coins, comprising:

a horizontal body member having a substantially flat top surface;

a vertical body member coupled to said horizontal body member at substantially a right angle to said horizontal body member, said vertical body member extending downwardly from said horizontal body member;

a juncture portion of said horizontal and vertical body members defining a curved receiving surface for receiving a roll of coins; and a stationary blade means on said curved receiving surface at said juncture portion and projecting from said curved receiving surface for piercing a wrapper of a coin roll when said coin roll is struck up against said blade means.

12. The coin roll opening device of claim 11, wherein said curved receiving surface includes a lip member, coupled to said vertical body member along a top edge portion of said vertical body member, for holding said blade means.

13. The coin roll opening device of claim 12, wherein the substantially flat top surface of the horizontal body member includes a curved indentation at said juncture portion where said horizontal body member, said vertical body member and said lip member meet.

14. The coin roll opening device of claim 12, wherein said blade means extends upward from a bottom portion of said lip member to below said substantially flat top surface of said horizontal body member.

15. The coin roll opening device of claim 12, wherein said blade means extends upward from a bottom portion of said lip member at an angle outwardly inclined from said vertical body member.

16. The coin roll opening device of claim 12, wherein said top edge portion of said vertical body member extends above said substantially flat top surface of said horizontal body member.

17. The coin roll opening device of claim 11, wherein a gripping means is affixed to a bottom face of said horizontal body member for grippingly mounting said coin roll opening device on a countertop, cash register or other object.

18. The coin roll opening device of claim 17, wherein said gripping means includes cushioning means for absorbing shock when said coin roll is struck up against the coin roll opening device.

19. The coin roll opening device of claim 11, wherein said substantially flat top surface of said horizontal body member includes advertising space.

20. The coin roll opening device of claim 11, wherein said substantially flat top surface of said horizontal body member includes insertion means for accepting, holding and allowing removal of an insertable advertising message.

* * * * *